US009255717B2

(12) United States Patent
Nam

(10) Patent No.: US 9,255,717 B2
(45) Date of Patent: Feb. 9, 2016

(54) CEILING MOUNTED AIR CONDITIONER

(75) Inventor: Jung Hyun Nam, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 410 days.

(21) Appl. No.: 13/141,603

(22) PCT Filed: Dec. 23, 2009

(86) PCT No.: PCT/KR2009/007701

§ 371 (c)(1),
(2), (4) Date: Sep. 9, 2011

(87) PCT Pub. No.: WO2010/074496

PCT Pub. Date: Jul. 1, 2010

(65) Prior Publication Data

US 2011/0319009 A1 Dec. 29, 2011

(30) Foreign Application Priority Data

Dec. 23, 2008 (KR) ..... 10-2008-0132343

(51) Int. Cl.

| | |
|---|---|
| ***F24F 7/00*** | (2006.01) |
| ***F24F 11/00*** | (2006.01) |
| ***F24F 13/06*** | (2006.01) |
| ***F24F 13/08*** | (2006.01) |
| ***F24F 1/00*** | (2011.01) |

(52) U.S. Cl.
CPC ..... *F24F 1/0007* (2013.01); *F24F 2001/0037* (2013.01); *F24F 2011/0036* (2013.01)

(58) Field of Classification Search
CPC ..... F24F 2001/0037; F24F 2011/0035; F24F 2013/0616
USPC ..... 454/256, 292, 295, 298
IPC ..... F24F 1/0007,2001/0036, 2001/0037
See application file for complete search history.

(56) References Cited

U.S. PATENT DOCUMENTS

| | | | | | |
|---|---|---|---|---|---|
| 3,697,151 | A | * | 10/1972 | Skolnick et al. | 359/484.03 |
| 3,823,653 | A | * | 7/1974 | Roos | 454/298 |
| 4,526,227 | A | * | 7/1985 | Baker | 165/124 |
| 4,616,559 | A | * | 10/1986 | Barlow | 454/298 |
| 4,686,893 | A | * | 8/1987 | Jinkins | 454/284 |

(Continued)

FOREIGN PATENT DOCUMENTS

| | | | |
|---|---|---|---|
| JP | 06-300341 | A | 10/1994 |
| JP | 2007-032887 | A | 2/2007 |

(Continued)

*Primary Examiner* — Steven B McAllister
*Assistant Examiner* — Helena Kosanovic
(74) *Attorney, Agent, or Firm* — Dentons US LLP

(57) ABSTRACT

A ceiling mounted air conditioner is provided. The ceiling mounted air conditioner includes a main body configured to be fixed onto a ceiling and have an open bottom; an outlet panel configured to be coupled to a lower part of the main body and have a plurality of air outlets; an intake panel configured to be coupled to the outlet panel and have an air intake; a door panel configured to be lifted up or down from the bottom of the intake panel and thus to open or shut the air intake; and a human body sensor module configured to be installed in the door panel, to begin to operate when the door panel is lifted down and to sense a movement of a user. Since the ceiling mounted air conditioner can blow air-conditioned air toward the user in a localized manner, it is possible to improve the performance of the ceiling mounted air conditioner.

15 Claims, 8 Drawing Sheets

(56) References Cited

U.S. PATENT DOCUMENTS

| | | | | |
|---|---|---|---|---|
| 5,001,968 | A * | 3/1991 | Sodec et al. | 454/302 |
| 5,331,825 | A * | 7/1994 | Kim | 62/180 |
| 5,372,545 | A * | 12/1994 | Noda et al. | 454/256 |
| 5,556,335 | A * | 9/1996 | Holyoake | 454/258 |
| 6,354,936 | B1 * | 3/2002 | Noh et al. | 454/201 |
| 6,450,880 | B1 * | 9/2002 | Asahina et al. | 454/233 |
| 6,520,247 | B2 * | 2/2003 | Hultmark | 165/56 |
| 6,718,780 | B2 * | 4/2004 | Cho et al. | 62/186 |
| 6,725,684 | B2 * | 4/2004 | Lee et al. | 62/298 |
| 6,802,361 | B2 * | 10/2004 | Hatanaka | 165/53 |
| 7,185,504 | B2 * | 3/2007 | Kasai et al. | 62/186 |
| 7,530,189 | B2 * | 5/2009 | Kim et al. | 40/725 |
| 8,006,512 | B2 * | 8/2011 | Sanagi et al. | 62/426 |
| 8,057,565 | B2 * | 11/2011 | Yabu et al. | 55/378 |
| 8,146,707 | B2 * | 4/2012 | Choi et al. | 181/225 |
| 8,387,404 | B2 * | 3/2013 | Choi et al. | 62/132 |
| 8,516,648 | B2 * | 8/2013 | Sakashita et al. | 15/301 |
| 8,715,047 | B2 * | 5/2014 | Kim | 454/254 |
| 8,834,242 | B2 * | 9/2014 | Uenaka et al. | 454/254 |
| 2006/0168862 | A1 * | 8/2006 | Kim et al. | 40/725 |
| 2006/0199513 | A1 * | 9/2006 | Choi et al. | 454/237 |
| 2006/0276123 | A1 * | 12/2006 | Sanagi et al. | 454/292 |
| 2007/0137243 | A1 * | 6/2007 | Lee et al. | 62/419 |
| 2008/0254734 | A1 * | 10/2008 | Uenaka et al. | 454/256 |
| 2009/0098820 | A1 * | 4/2009 | Yabu | 454/333 |
| 2010/0192611 | A1 * | 8/2010 | Yamaguchi et al. | 62/291 |

FOREIGN PATENT DOCUMENTS

| | | | |
|---|---|---|---|
| JP | 2007032887 | | 2/2007 |
| JP | 2008-209099 | A | 9/2008 |
| KR | 10-2006-0095636 | A | 9/2006 |
| KR | 1020060095636 | A | 9/2006 |

* cited by examiner

CEILING MOUNTED AIR CONDITIONER

This application is a 35 U.S.C. §371 National Stage entry of International Application No. PCT/KR2009/007701, filed on Dec. 23, 2009, which claims the benefit of the earlier filing date and right of priority to Korean Application No. 10-2008-0132343, filed Dec. 23, 2008, the contents of which are hereby incorporated by reference herein for all purposes in their entireties.

TECHNICAL FIELD

The present invention relates to a ceiling mounted air conditioner, and more particularly, to a ceiling mounted air conditioner which includes a human body sensor module installed at a door panel capable of opening or shutting an air intake by being vertically lifted up or down and can thus sense the movement of a user with the use of the human body sensor module and blow air-conditioned air toward the user based on the results of the sensing.

BACKGROUND ART

In general, ceiling mounted air conditioners are devices for controlling indoor temperature by discharging air-conditioned air into a room and can be installed at the ceiling of a room.

Ceiling mounted air conditioners perform various functions not only including an air-conditioning function but also including an air-circulating function and an air-filtering function.

However, conventional ceiling mounted air conditioners simply blow air-conditioned air into a room through air outlets regardless of the location of a user in the room and thus may not be able to provide localized air conditioning.

DISCLOSURE

Technical Problem

The present invention provides a ceiling mounted air conditioner which includes a human body sensor module installed on a door panel capable of opening or shutting an air intake by being vertically lifted up or down and can thus blow air-conditioned air toward a user based on the results of sensing performed by the human body sensor module.

Technical Solution

According to an aspect of the present invention, there is provided a ceiling mounted air conditioner including a main body configured to be fixed onto a ceiling and have an open bottom; an outlet panel configured to be coupled to a lower part of the main body and have a plurality of air outlets; an intake panel configured to be coupled to the outlet panel and have an air intake; a door panel configured to be lifted up or down from the bottom of the intake panel and thus to open or shut the air intake; and a human body sensor module configured to be installed in the door panel, to begin to operate when the door panel is lifted down and to sense a movement of a user.

The door panel may shut the air intake when placed in contact with the bottom of the intake panel and open the air intake when detached from the bottom of the intake panel.

The door panel may include an installation hole through which the human body sensor module is installed in the door panel.

The installation hole may be formed anywhere on the door panel except the middle of the door panel.

The installation hole may be formed anywhere on the door panel except a part of the door panel directly below the air intake.

The human body sensor module may include a sensor case which is disposed over the installation hole, protrudes beyond the installation hole and covers the installation hole, a printed circuit board (PCB) rotator which is disposed in the sensor case so as to be able to rotate and has a PCB installed thereon, a PCB driving motor which rotates the PCB rotator, and a human body sensor which is installed on the PCB.

The human body sensor module may also include a sensor protection cover, which is disposed below the installation hole and is coupled to a lower part of the sensor case so as to cover the installation hole and protect the human body sensor.

When coupled to the sensor case, the sensor protection cover may protrude downwardly beyond the bottom of the door panel.

When coupled to the sensor case, a portion of the sensor protection cover may be inserted into the installation hole and the middle of the bottom of the sensor protection cover protrudes downwardly beyond the bottom of the door panel.

The PCB rotator may include a connector portion which is connected to a rotation axis of the PCB driving motor so as to be able to rotate, and a PCB installation portion which is formed in one body with a lower part of the connector portion and has the PCB installed thereon.

The PCB installation portion may be formed at an inclination to the rotation axis of the PCB driving motor.

The human body sensor module may also include a stopper which prevents an excessive rotation of the PCB rotator.

The stopper may include a protrusion which rotates along with the PCB rotator and protrudes from the connector portion or the PCB installation portion toward the sensor case, and a latch which is formed in the sensor case so as to interfere in the protrusion.

The human body sensor module may also include lead wire which connects the PCB and a power supply unit disposed outside the sensor case, and a separation portion which is formed between the sensor case and the sensor protection cover and connects the sensor case and the sensor protection cover so as for the lead wire to be connected to the PCB therethrough.

Advantageous Effects

According to the present invention, it is possible to precisely determine the location of a user with the use of a human body sensor module and thus to blow air-conditioned air exactly toward the user. Therefore, it is possible to maximize user satisfaction. In addition, it is possible to improve the performance of a ceiling mounted air conditioner by providing localized air conditioning.

BEST MODE

The present invention will hereinafter be described more fully with reference to the accompanying drawings, in which exemplary embodiments of the invention are shown.

Figure 1:
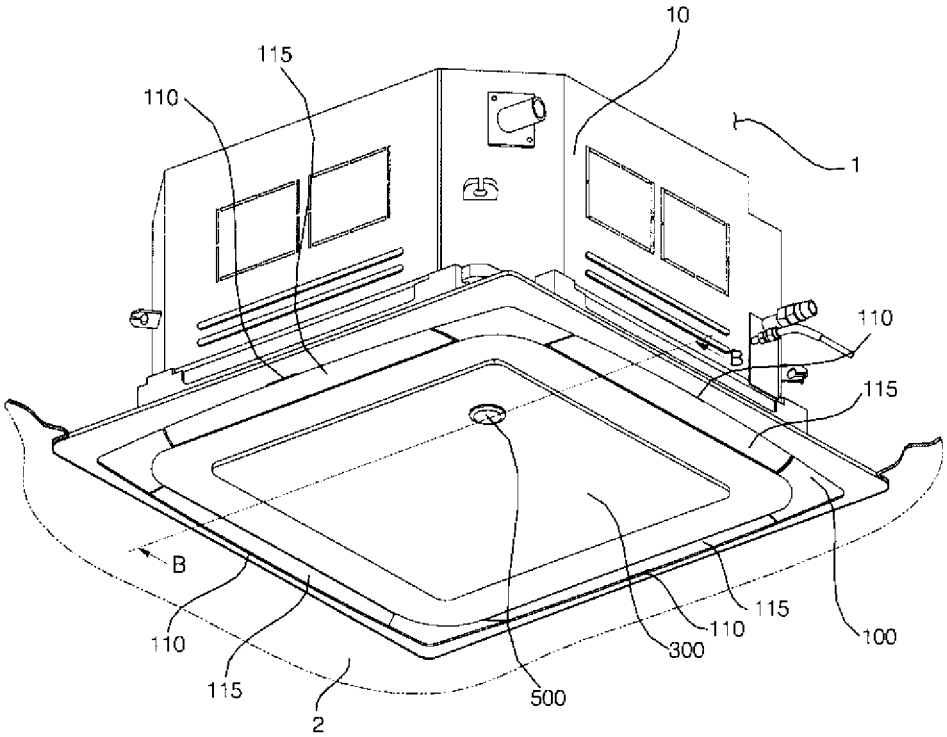
FIG. 1 illustrates a perspective view of a ceiling mounted air conditioner according to an exemplary embodiment of the present invention.
Figure 2:
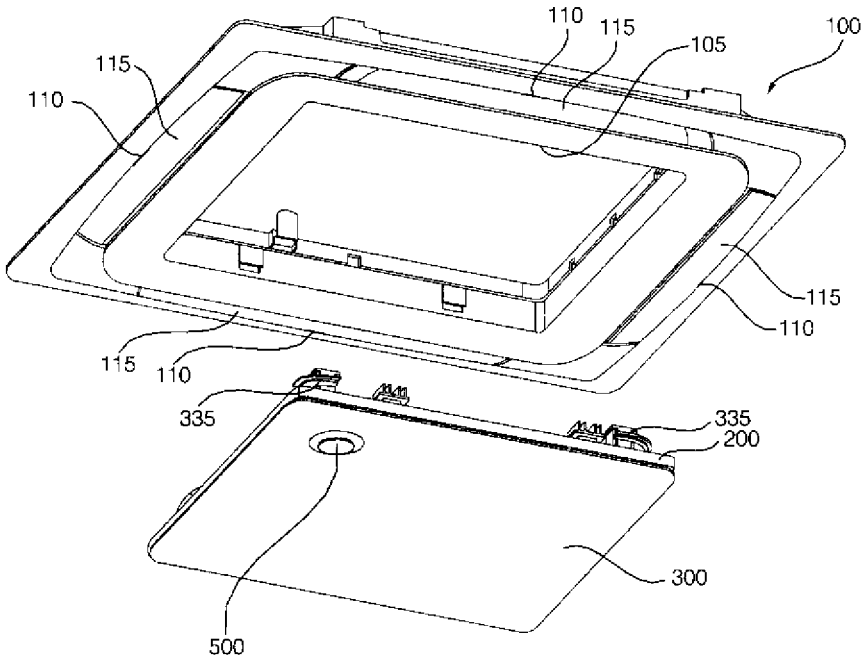
FIG. 2 illustrates an exploded perspective view of an outlet panel, an intake panel and a door panel shown in FIG. 1.
Figure 3:
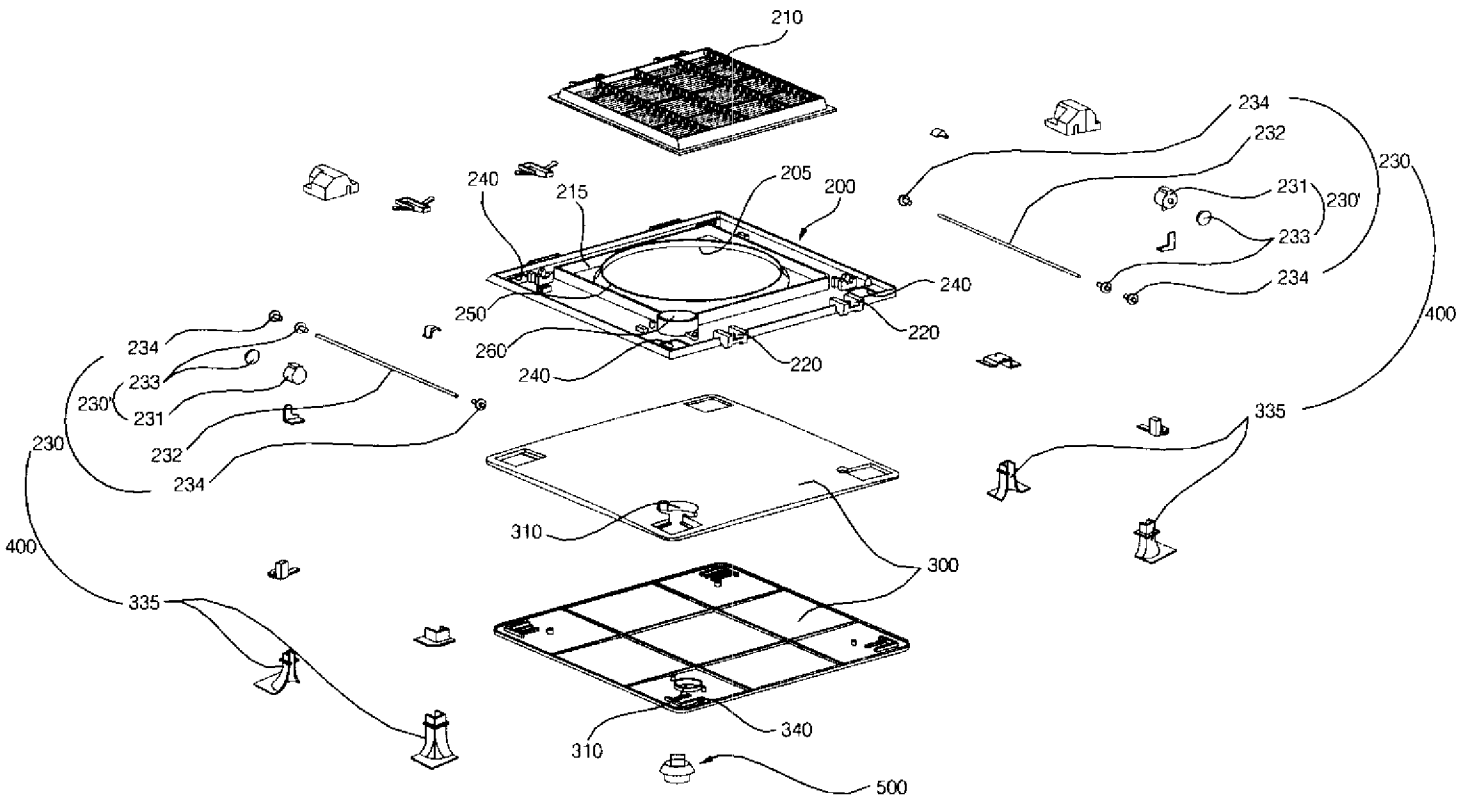
FIG. 3 illustrates an exploded perspective view of the intake panel and the door panel.
Figure 4:
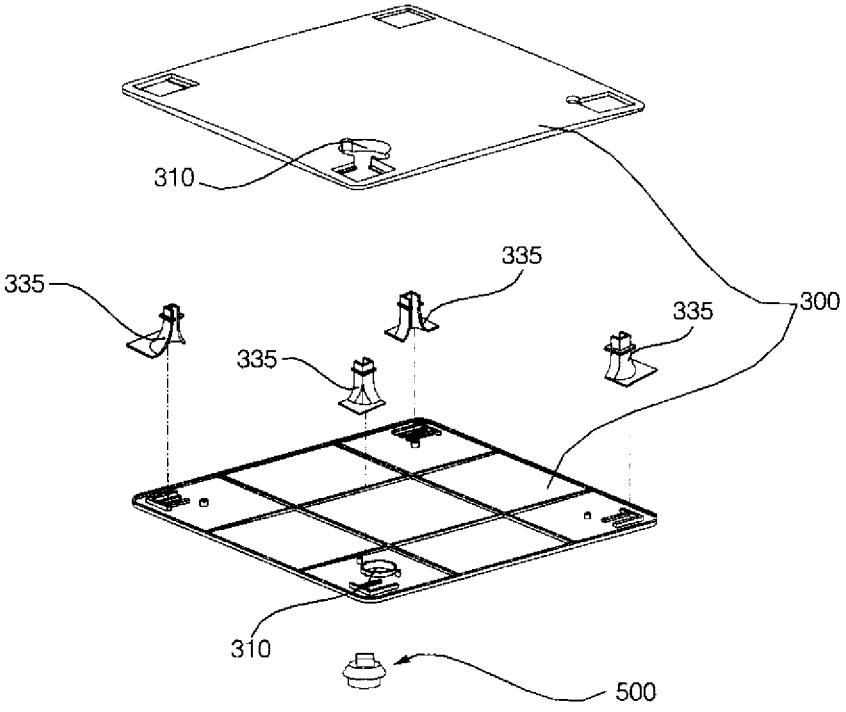
FIG. 4 illustrates a detailed exploded perspective view of the door panel.
Figure 5:
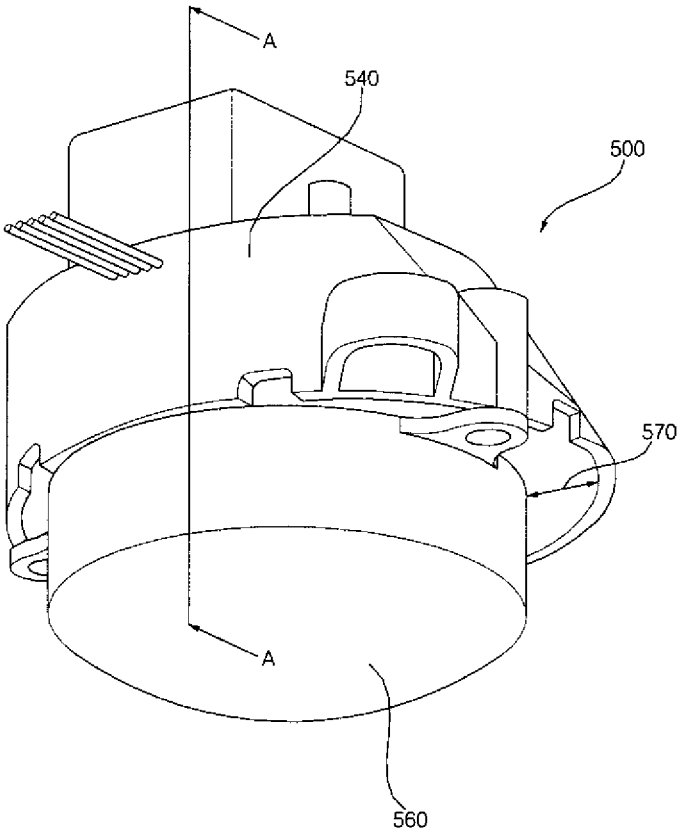
FIG. 5 illustrates a perspective view of a human body sensor module shown in FIG. 4.
Figure 6:
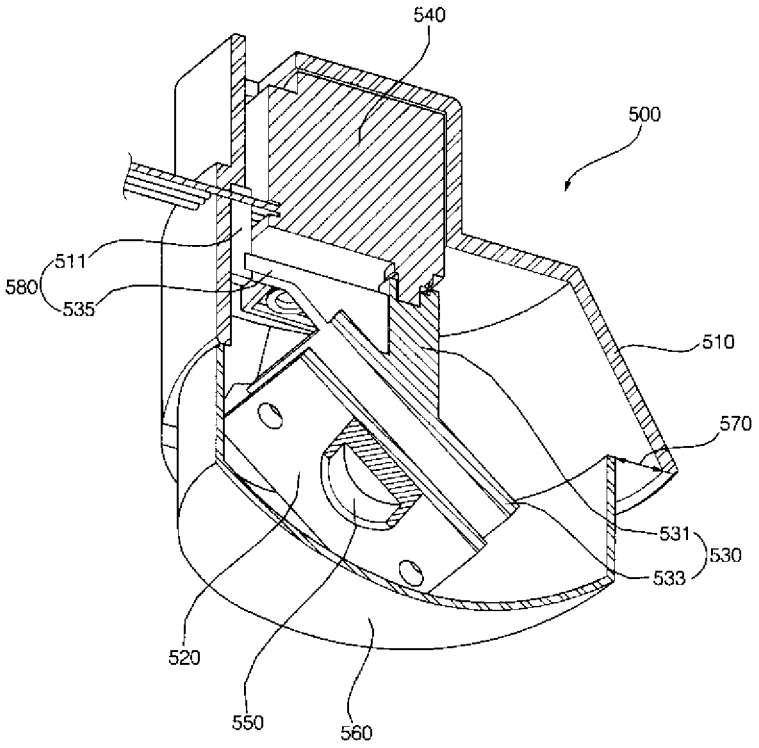
FIG. 6 illustrates an exploded perspective view taken along line A-A of FIG. 5.
Figure 7:
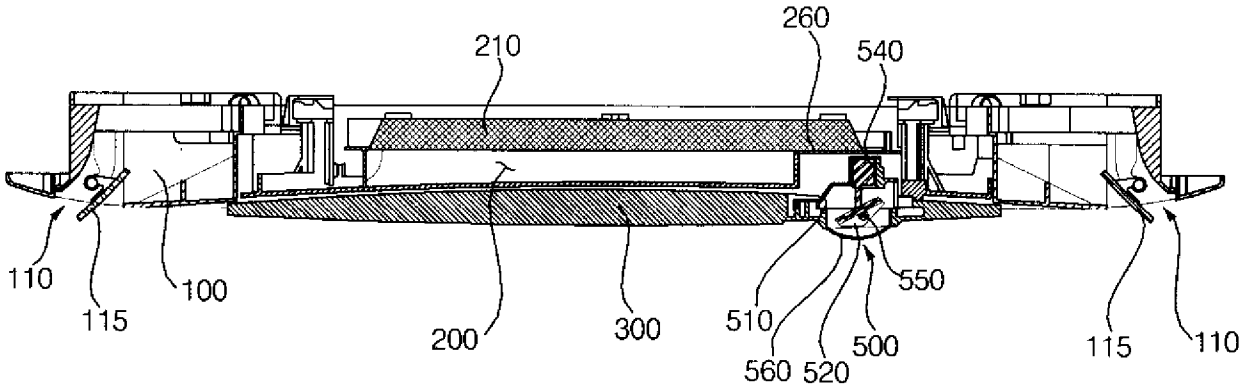
FIG. 7 illustrates a cross-sectional view taken along line B-B of FIG. 1.
Figure 8:
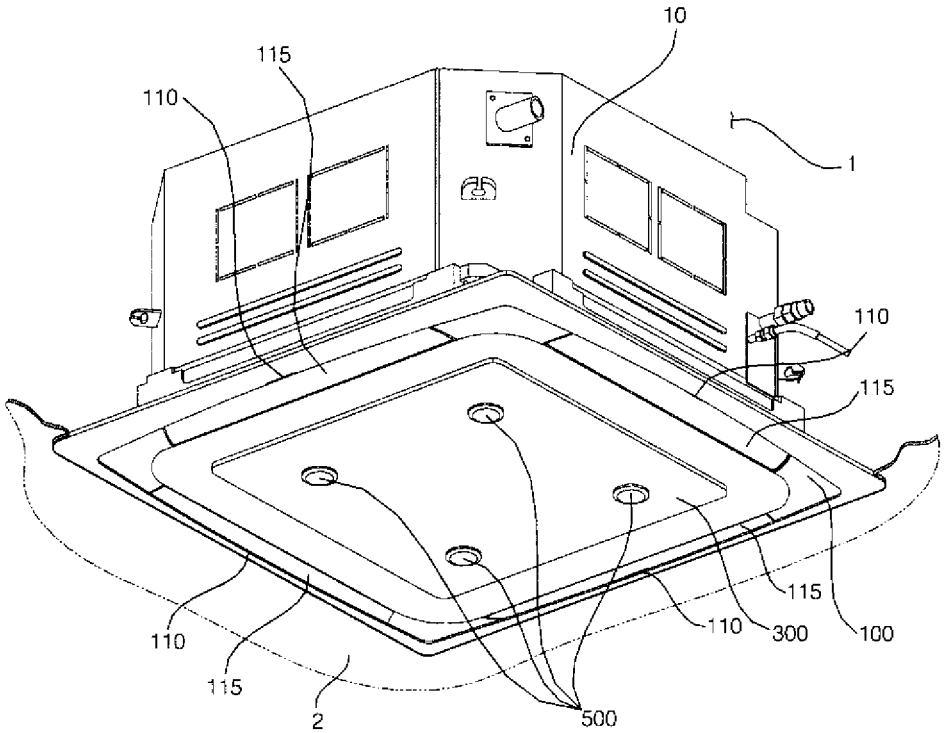
FIG. 8 illustrates a perspective view of a ceiling mounted air conditioner according to another exemplary embodiment of the present invention.

FIG. 1 illustrates a perspective view of a ceiling mounted air conditioner according to an exemplary embodiment of the present invention, FIG. 2 illustrates an exploded perspective view of an outlet panel 100, an intake panel 200 and a door panel 300 shown in FIG. 1, FIG. 3 illustrates an exploded perspective view of the intake panel 200 and the door panel 300, FIG. 4 illustrates a detailed exploded perspective view of the door panel 300, FIG. 5 illustrates a perspective view of a human body sensor module 500 shown in FIG. 4, FIG. 6 illustrates an exploded perspective view taken along line A-A of FIG. 5, FIG. 7 illustrates a cross-sectional view taken along line B-B of FIG. 1, and FIG. 8 illustrates a perspective view of a ceiling mounted air conditioner according to another exemplary embodiment of the present invention.

Referring to FIGS. 1 and 7, the ceiling mounted air conditioner may include a main body 10 disposed between a ceiling 1 and a ceiling finishing material 2.

The main body 10 may have an open bottom. Thus, an air-blowing fan 5, which draws indoor air into the main body 10 and discharges the air, a heat exchanger 7, which exchanges heat with the indoor air, may be installed in the main body 10.

More specifically, the main body 10 may be formed as a square or rectangular box having an open bottom, and may thus be able to accommodate the air-blowing fan 5 and the heat exchanger 7 therein.

An outlet panel 100 may be installed at the bottom of the main body 10, and may be on a level with the ceiling finishing material 2. The outlet panel 100 may hide the bottom of the main body 10 from view. The outlet panel 100 may have an opening 105 in the middle, and may thus accommodate an intake panel 200 therein. The outlet panel 100 may include a plurality of air outlets 110 which are formed along the boundaries of the outlet panel 100 and discharge air processed in the main body 10.

The outlet panel 100 may be formed as a rectangular frame, conforming to the shape of the bottom of the main body 10, and may thus be able to effectively hide the bottom of the main body 10 from view.

A plurality of wind vanes 115 may be installed in their respective air outlets 110. The wind vanes 115 may open or shut their respective air outlets 110 by rotating by a predetermined angle, and may adjust the direction of flow of air discharged from the air outlets 110.

Referring to FIGS. 2 and 3, the intake panel 200 may be installed inside the outlet panel 100 so as to shut the opening 105 of the outlet panel 100.

The intake panel 200 may have an air intake 205 in the middle, and may thus allow indoor air to be drawn into the main body 10. A purification filter 210 may be disposed above the air intake 205 and may filter out impurities in the air drawn into the main body 10. A purification filter installation unit 215 may be formed on the top surface of the intake panel 200 so as for the purification filter 210 to be installed on the intake panel 200.

The air intake 205 of the intake panel 200 may be formed as a circle and may thus allow indoor air to be drawn into the center of the main body 10. The intake panel 200 may not only provide room for the installation of the purification filter 210, but also serve as an orifice for adjusting the amount and speed of air drawn into the main body 10.

However, the air intake 205 may not necessarily have to be formed as a circle. That is, the air intake 205 may be formed in various shapes other than a circular shape.

Referring to FIGS. 1 through 3, the ceiling mounted air conditioner may also include the door panel 300, which can be lifted up or down and can thus open or shut the air intake 205 of the intake panel 200.

The size of the door panel 300 may correspond to the size of the intake panel 200. More specifically, the size of the door panel 300 may be greater than the size of the intake panel 200, so the intake panel 200 can be hidden from view by the door panel 300 when the door panel 300 is lifted up and thus shuts the air intake 205 of the intake panel 200.

The opening 105 may be formed as a square or rectangle. The intake panel 200 may also be formed as a square or rectangle, conforming to the shape of the opening 105.

When lifted up, the door panel 300 may be placed in contact with the bottom of the intake panel 200 and may thus shut the air intake 205. On the other hand, when lifted down, the door panel 300 may be detached downwardly from the bottom of the intake panel 200 and may thus open the air intake 205.

Referring to FIG. 3, the ceiling mounted air conditioner may also include a plurality of elevation driving units 230 which are disposed on the top surface of the intake panel 200 and apply driving force to the door panel 300 so as for the door panel 300 to be lifted up or down.

More specifically, the elevation driving units 230 may be a predetermined distance apart from each other. In this exemplary embodiment, two elevation driving units 230 may be disposed on and extend either vertically or horizontally along a pair of opposite sides of the intake panel 200.

Each of the elevation driving units 230 may include a motor 231, which is disposed on the intake panel 200, a shaft 232, which is arranged in line with the rotation axis of the motor 231, a connecting element 233 which connects the motor 231 and the shaft 232 and thus allows the shaft 232 to rotate along with the motor 231, and a plurality of rotation elements 234, which are installed at either end of the shaft 232 and can rotate the shaft 232.

Referring to FIG. 6, two motors 231 may be disposed on a pair of opposite sides of the intake panel 200. Two shafts 232 may be disposed on the opposite sides of the intake panel 200 where the two motors 231 are disposed, and may be isolated from each other.

For convenience, the motors 231 and their respective connecting elements 233 will hereinafter be collectively referred to as shaft driving units 230'.

It is important to precisely control the motors 231 because the rotation speed of the motors 231 affects the elevation of the door panel 300. That is, if the motors 231 have different rotation speeds, the door panel 300 may not be able to be uniformly elevated, and may thus adversely affect the exterior appearance of the ceiling mounted air conditioner.

Each of the connecting elements 233 may include a motor gear 233A, which is connected to the rotation axis of a corresponding motor 231, and a shaft gear 233B, which engages with the motor gear 233A and rotates a corresponding shaft 232 by rotating along with the motor gear 233A.

When turned on with the use of, for example, a remote control, the motors 231 may rotate. As a result, the connecting elements 233 may rotate, and the shafts 232 may rotate about their rotation axes. Then, the rotation elements 234 may rotate accordingly.

The ceiling mounted air conditioner may also include the door panel 300, which can be lifted up or down and can thus open or shut the air intake 205 of the intake panel 200.

More specifically, referring to FIGS. 4A and 4B, when lifted up, the door panel 300 may be placed in contact with the bottom of the intake panel 200. On the other hand, when lifted down, the door panel 300 may be detached downwardly from the intake panel 200 and may thus open the air intake 205 of the intake panel 200 and guide indoor air into the main body 10 through the air intake 205.

Referring to FIG. 4B, the ceiling mounted air conditioner may also include a plurality of moving elements 335, which are installed on the door panel 300. The moving elements 335 extend vertically, and may be lifted up or down in accordance with the rotation of the rotation elements 234.

The moving elements 335 may be coupled onto the top surface of the door panel 300, and may lift up or down the door panel 300.

Given that the moving elements 335 are used along with the elevation driving units 230 to lift up or down the door panel 300, each of the moving elements 335 and each of the elevation driving units 230 (including a motor 231, a shaft 232, a connecting element 233 and a plurality of rotation elements 234) will hereinafter be collectively referred to as elevation devices 400.

The ceiling mounted air conditioner may also include a plurality of elevation guide holes 240, which are formed through the intake panel 200 so that the moving elements 335 can be lifted up or down through the elevation guide holes 240.

The rotation elements 234 may be pinion gears, which rotate about the axes of their respective shafts 232, and the moving elements 335 may be rack gears which engage with the pinion gears.

Referring to FIGS. 1, 5 and 7, the ceiling mounted air conditioner may also include the human body sensor module 500, which is installed at the door panel 300 so as to be able to be lifted up or down along with the door panel 300. The human body sensor module 500 may begin to operate when the door panel 300 is lifted down. The human body sensor module 500 may sense the movement of a user.

More specifically, the human body sensor module 500 may detect infrared rays emitted from the user and may thus locate the user.

The human body sensor module 500 may be installed through the door panel 300. Since the door panel 300 is formed thinly of a light-weight material in order to be effectively lifted up against the force of gravity, the human body sensor module 500 may protrude beyond the door panel 300. For the installation of the human body sensor module 500 through the door panel 300, an installation hole 310 may be formed through the door panel 300.

The installation hole 310 may be formed on any part of the door panel 300 except for a central part of the door panel 300 in consideration of the possibility that the door panel 300 may be used for decoration or lighting purposes. Since the installation hole 310 is formed off-center, it is possible to prevent or avoid flow resistance that may occur if the human body sensor module 500 is disposed on the flow path of air drawn into the main body 10 through the air intake 205.

More specifically, the installation hole 310 may be formed anywhere on the door panel 300 except for a part of the door panel 300 directly below the air intake 205.

Referring to FIG. 7, in order to prevent the intake panel 200 from being distorted by the intake panel 200 when the door panel 300 is lifted up and is thus placed in contact with the intake panel 200, the intake panel 200 may also include a human body sensor cover portion 260, which conforms to the shape of an upper part of the human body sensor module 500 and can thus accommodate the human body sensor module 500 therein.

The human body sensor cover portion 260 may not necessarily have to conform to the shape of the upper part of the human body sensor module 500. That is, the human body sensor cover portion 260 may have any shape as long as it can accommodate the upper part of the human body sensor module 500 therein. The human body sensor cover portion 260 may be formed at the bottom of the intake panel 200 as a recess having a predetermined depth. The human body sensor cover portion 260 may be formed in one body with the intake panel 200.

The depth of the human body sensor cover portion 260 may be greater than the height by which the human body sensor module 500 protrudes beyond the top surface of the door panel 300.

The structure of the human body sensor module 500 will hereinafter be described in detail with reference to FIGS. 5 and 6.

Referring to FIGS. 5 and 6, the human body sensor module 500 may include a sensor case 510, which protrudes over the installation hole 310 so as to cover the installation hole 310, a printed circuit board (PCB) rotation unit 530, which is installed in the sensor case 510 so as to be able to rotate and includes a PCB 520, a PCB driving motor 540, which rotates the PCB rotator 530, and a human body sensor 550, which his installed on the PCB 520.

The PCB rotator 530 may include a connector portion 531, which is connected to the rotation axis of the PCB driving motor 540 so as to be able to rotate, and a PCB installation portion 533, which is formed in one body with the connector portion 531, and on which the PCB 520 is installed.

The PCB installation portion 533, on which the PCB 520 and the human body sensor 550 are installed, may be formed at an inclination to the rotation axis of the PCB driving motor 540 in order for the human body sensor 550 to properly sense the entire room where the ceiling mounted air conditioner is installed. That is, given that the ceiling mounted air conditioner is highly likely to be installed in the middle of the ceiling 1, the PCB driving motor 540 may be driven to rotate, and the PCB installation portion 533 may be installed at an inclination to the rotation axis of the PCB driving motor 540 and may thus be able to rotate along with the PCB driving motor 540. Therefore, the human body sensor 550 of the human body sensor module 500 can cover a wide area and can thus effectively locate the user.

The human body sensor module 500 may also include a sensor protection cover 560, which protrudes beyond the bottom of the door panel 300 and is coupled to the sensor case 510 so as to protect the human body sensor 550.

More specifically, when coupled to the bottom of the sensor case 510, the sensor protection cover 560 may protrude beyond the bottom of the door panel 300.

Since the sensor protection cover 560 is configured to protrude beyond the bottom of the door panel 300, it is possible to cover a wide area and effectively locate the user without being interfered with.

For this, an upper portion of the sensor protection cover 560, which is coupled to the sensor case 510, may be inserted in the installation hole 310, and the sensor protection cover 560 may have a curved bottom surface and may thus be able to protrude beyond the bottom of the door panel 300.

The human body sensor module 500 may also include lead wire (not shown) which connects the PCB 620 and a power supply unit (not shown) disposed outside the sensor case 510.

Since the lead wire connects the PCB 520, which rotates inside the PCB case 510, and the power supply unit, the lead wire should be able to rotate along with the PCB 520. In this case, however, the lead wire may be interfered with or caught by other elements of the human body sensor module 500 and may thus interfere with the rotation of the PCB 520.

In order to address this problem, the bottom of the sensor case 510 may be configured to have a greater diameter than the sensor protection cover 560, and the human body sensor module 500 may also include a separation portion 570 which connects the bottom of the sensor case 510 and the sensor protection cover 560.

The lead wire may connect the PCB 520 and the power supply unit through the separation portion 570, and may thus be able to be properly guided by the separation portion 570 during the rotation of the PCB 520 inside the PCB case 510.

The PCB driving motor 540 may include a step motor which rotates in one direction by 360 degrees and then rotating in the other direction by 360 degrees so as to return to its original direction. In this case, it is possible to prevent the lead wire from being tangled inside the PCB case 510 due to the rotation of the PCB driving motor 540.

In short, the rotation of the PCB rotator 530 may be properly restricted in order to prevent the PCB 520 from being rotated by more than 360 degrees.

That is, the human body sensor module 500 may also include a stopper 580 which prevents an excessive rotation of the PCB rotator 530.

The stopper 580 may include a protrusion 535 which can rotate along with the PCB rotator 530 and protrudes from the connector portion 531 or the PCB installation portion 533 toward the sensor case 510, and a latch 511 which is formed in the sensor case 510 so as to interfere in the protrusion 535.

The protrusion 535 may be formed in one body with the PCB installation portion 533, but the present invention is not restricted to this. That is, the protrusion 535 may be formed on the PCB installation portion 533 and may protrude from one side of the connector portion 531. Alternatively, the protrusion 535 may be formed in anywhere else but the sensor case 510 within the rotation diameter of the protrusion 535.

The ceiling mounted air conditioner may also include an integrated controller (not shown) which controls the operations of the air blower 5, the heat exchanger 7, the motors 231 of the elevation driving units 230, and the human body sensor module 500.

The operation of the ceiling mounted air conditioner will hereinafter be described in detail.

When a predetermined signal for turning on the ceiling mounted air conditioner is applied to the ceiling mounted air conditioner with the use of, for example, a remote control, the controller may operate the air blower 5 and the heat exchanger 7. Then, the controller may operate the motors 231 so as to lift down the door panel 300 against the intake panel 200, and at the same time, may rotate the PCB driving motor 540 of the human body sensor module 500.

The human body sensor 550 of the human body sensor module 500 may precisely determine the location of the user in the room where the ceiling mounted air conditioner is installed, and may transmit the results of the determination to the controller as an electric signal. The controller may selectively open the air outlets 105 of the outlet panel 100 in consideration of the location of the user and may thus effectively blow air-conditioned air toward the user.

More specifically, in order to blow air conditioned air toward the user, the controller 180 may appropriately adjust the rotation angle of the wind vanes 115.

Thereafter, when a predetermined signal for turning off the ceiling mounted air conditioner is applied to the ceiling mounted air conditioner with the use of, for example, a remote control, the controller may stop operating the air blower 5 and the heat exchanger 7. Then, the controller may operate the motors 231 so as to lift up the door panel 300 and thus to place the door panel 300 in contact with the bottom of the intake panel 200, and at the same time, may stop rotating the PCB driving motor 540 of the human body sensor module 500. As a result, the operation of the ceiling mounted air conditioner may be terminated.

The structure and operation of the ceiling mounted air conditioner have been described above with reference to FIGS. 1 through 7, but the present invention is not restricted to this.

For example, referring to FIG. 8, the ceiling mounted air conditioner may include a plurality of human body sensor modules 500, which are provided on the door panel 300 and are a predetermined distance apart from one another. In this case, the ceiling mounted air conditioner can cover a wider area and scan the user more precisely than when having only one human body sensor module 500. Obviously, the ceiling mounted air conditioner may need a more complicated control logic when having a plurality of human body sensor modules 500 than when having only one human body sensor module 500.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A ceiling mounted air conditioner comprising:

a main body configured to be fixed onto a ceiling and have an open bottom;

an outlet panel configured to be coupled to a lower part of the main body and have a plurality of air outlets;

an intake panel configured to be coupled to the outlet panel and have an air intake in a middle;

a door panel configured to be lifted up or down from a bottom surface of the intake panel and correspond to a size of the intake panel such that the door panel shuts the air intake when placed in surface contact with the bottom surface of the intake panel and opens the air intake when detached from the bottom surface of the intake panel; and a human body sensor module installed in the door panel, to operate when the door panel is lifted down and senses a user, wherein the human body sensor module is spaced inside from the air outlets, wherein the intake panel includes a human body sensor cover portion to accommodate therein an upper portion of the human body sensor module protruded upward from the door panel.

2. The ceiling mounted air conditioner of claim 1, wherein the door panel includes an installation hole through which the human body sensor module is installed in the door panel.

3. The ceiling mounted air conditioner of claim 2, wherein the installation hole is formed anywhere on the door panel except the middle of the door panel.

4. The ceiling mounted air conditioner of claim 2, wherein the installation hole is formed anywhere on the door panel except a part of the door panel directly below the air intake.

5. A ceiling mounted air conditioner comprising:

a main body configured to be fixed onto a ceiling and have an open bottom;

an outlet panel configured to be coupled to a lower part of the main body and have a plurality of air outlets;

an intake panel configured to be coupled to the outlet part and have an air intake in a middle;

a door panel configured to be lifted up or down from a bottom surface of the intake panel and corresponds to a size of the intake panel such that the door panel shuts the air intake when placed in surface contact with the bottom surface of the intake panel and opens the air intake when detached from the bottom surface of the intake panel; and a human body sensor module installed in the door panel, to operate when the door panel is lifted down and senses a user, wherein the human body sensor module includes a sensor case which is disposed over the installation hole, protrudes beyond the installation hole and covers the installation hole, a printed circuit board (PCB) rotator which is disposed in the sensor case so as to be able to rotate and has a PCB installed thereon, a PCB driving motor which rotates the PCB rotator, and a human body sensor which is installed on the PCB, wherein the PCB rotator includes a connector portion which is connected to a rotation axis of the PCB driving motor so as to be able to rotate, and a PCB installation portion which is formed in one body with a lower part of the connector portion and has the PCB installed thereon, wherein the PCB installation portion is formed at an inclination to the rotation axis of the PCB driving motor.

6. The ceiling mounted air conditioner of claim 5, wherein the human body sensor module further includes a sensor protection cover, which is disposed below the installation hole and is coupled to a lower part of the sensor case so as to cover the installation hole and protect the human body sensor.

7. The ceiling mounted air conditioner of claim 6, wherein, when coupled to the sensor case, the sensor protection cover protrudes downwardly beyond the bottom of the door panel.

8. The ceiling mounted air conditioner of claim 6, wherein, when coupled to the sensor case, a portion of the sensor protection cover is inserted into the installation hole and the middle of the bottom of the sensor protection cover protrudes downwardly beyond the bottom of the door panel.

9. The ceiling mounted air conditioner of claim 5, wherein the human body sensor module further includes a stopper which prevents an excessive rotation of the PCB rotator.

10. The ceiling mounted air conditioner of claim 9, wherein the stopper includes a protrusion which rotates along with the PCB rotator and protrudes from the connector portion or the PCB installation portion toward the sensor case, and a latch which is formed in the sensor case so as to interfere in the protrusion.

11. The ceiling mounted air conditioner of claim 5, wherein the human body sensor module further includes lead wire which connects the PCB and a power supply unit disposed outside the sensor case, and a separation portion which is formed between the sensor case and the sensor protection cover and connects the sensor case and the sensor protection cover so as for the lead wire to be connected to the PCB therethrough.

12. The ceiling mounted air conditioner of claim 1, further comprising a plurality of wind vanes at each air outlet, respectively, wherein the wind vanes may open or shut the respective air outlets.

13. The ceiling mounted air conditioner of claim 1, further comprising an elevation driving unit on a top surface of the intake panel to apply force to the door panel for the door panel to be lifted up and down.

14. The ceiling mounted air conditioner of claim 13, wherein the elevation driving unit includes a motor, a shaft, a rotation element, and a controller to control the motor.

15. The ceiling mounted air conditioner of claim 14, further including a moving element coupled to the door panel to extend vertically to be lifted up and down with rotation of the rotation element.

* * * * *